United States Patent [19]

Abduganiev et al.

[11] Patent Number: 4,672,801

[45] Date of Patent: Jun. 16, 1987

[54] APPARATUS FOR PRODUCING TWO-COMPONENT THREAD

[75] Inventors: Aburakhim Abduganiev; Gennady V. Zhigalov; Tatyana M. Batalkina, all of Tashkent, U.S.S.R.

[73] Assignee: Tashkentskoe Spetsialnoe Konstruktorskoe Bjuro Textilnykh Mashin, Tashkent, U.S.S.R.

[21] Appl. No.: 821,458

[22] Filed: Jan. 22, 1986

[51] Int. Cl.[4] ..... D01H 13/16; D01H 13/18

[52] U.S. Cl. ..... 57/86; 57/5; 57/19; 57/81; 57/87

[58] Field of Search ..... 57/5, 78, 80, 81, 83–87, 57/19

[56] References Cited

U.S. PATENT DOCUMENTS

| | | | |
|---|---|---|---|
| 3,177,642 | 4/1965 | Korikovsky | 57/19 X |
| 3,452,531 | 7/1969 | Watson | 57/86 |
| 4,117,654 | 10/1978 | Petrov et al. | 57/19 |
| 4,343,144 | 8/1982 | Ernst et al. | 57/81 X |
| 4,389,837 | 6/1983 | Stahlecker et al. | 57/19 X |
| 4,472,932 | 9/1984 | Guttler et al. | 57/86 X |
| 4,495,758 | 1/1985 | Stahlecker et al. | 57/19 |
| 4,519,196 | 5/1985 | Stahlecker | 57/19 X |
| 4,581,881 | 4/1986 | Lamb | 57/87 |

FOREIGN PATENT DOCUMENTS 706473 12/1979 U.S.S.R. .

*Primary Examiner*—John Petrakes

*Attorney, Agent, or Firm*—Fleit, Jacobson, Cohn & Price

[57] ABSTRACT

The apparatus for producing two-component thread comprises a twisting member to which the two components of the two-component thread are fed, and means for severing one of the components as the feed of the second component ceases, including a hollow cylinder operatively connected to a drive and having an annular slit made therein, with at least one flat knife accommodated in the internal space of the cylinder in the area adjoining the annular slit.

5 Claims, 12 Drawing Figures

APPARATUS FOR PRODUCING TWO-COMPONENT THREAD

FIELD OF THE INVENTION

The invention relates to spinning technologies in the textile industry, and more particularly it relates to an apparatus for producing two-component thread, such as reinforced thread.

The invention can be implemented in any machine in the textile industry, operable for production of two-component thread, such as a rotative spinning-cum-reinforcing machine, a spinning-cum-twisting machine, etc.

BACKGROUND OF THE INVENTION

It is generally known that one of the problems encountered in producing a two-component thread is the avoidance of winding into the bobbin the final thread when one of its two components is lacking for some reason.

This problem is solved, as a rule, by ensuring forced servering or breaking of the remaining other component of the two-component thread when the feed of the first component, which may be either one of the two, ceases, and this involves monitoring the presence of both components of the thread prior to their twisting together with aid of various techniques and devices. The most popular approach is monitoring by direct contact, i.e., by physically feeling each one of the components of the thread by means of various kinds of feelers or sensors.

However, this monitoring technique is feasible only in case of such types of two-components thread whose components allow for their physical feeling in direct contact with the feelers, i.e., have adequate relative strength and tension, which is the case of, for example, twisted threads or yarns.

There is also in existence another monitoring technique, namely, that of monitoring the thickness of the final thread after the twisting together of the components, when sudden thinning of the final thread is considered a proof of distruption of the normal process of production of the thread, and used as a signal for actuating corresponding mechanisms. This technique is the obvious choice in case of two-component thread types where the twisted- or wound-around component is separated fibers that would not be physically contacted by a feeler.

The simplest devices embodying this technique are those employing the principle of go and no-go gages. A device of this kind normally includes an element engaged by the running thread and having a slit whose width is greater than the thickness of a single component of the thread, but short of the thickness of the final thread. Should either one of the components of the two-component thread become broken or its supply exhausted, the other component slips into the slit, which serves as a signal of disruption of the normal production process.

Efficient and reliable performance of devices of the above-described kind, however, can be ensured only when the ratio of the thickness of one of the components to that of the final thread is as small as 1:5 to 1:10, or even smaller.

Various devices are known employing the abovedescribed go/no-go gage principle. These devices in most cases incorporate a complex system of transmitting a signal of disruption of the production process to actuating members, these actuating members themselves being also quite complicated. Furthermore, the considerable distance from the location of the pickup with its feeler or gage to the spot where the remaining component is forcedly broken or severed results in an increased amount of waste in the form of a single thread and complicates the procedure of making good the breakage, as the remaining single component of the thread is wound into the final bobbin and requires subsequent removal.

There is known an apparatus for producing twocomponent thread (cf. SU Inventor's Certificate No. 706,473; Int.Cl.$^2$ DO1H 13/16, dated 1979) comprising a twisting member, a holder of a package with one component of the two-component thread, means for feeding the other component of the two-component thread into the twisting member, a unit for winding the two-component thread, including a package holder having an axle for its rotation, and a device for severing one of the components of the two-component thread when the feed of the other component thereof ceases, arranged intermediate the twisting member and the winding unit and including an element adapted to engage the two-component thread, having a slit of a width which is short of the thickness of the two-component thread and in excess of the thickness of one of the components of the two-component thread.

In the apparatus being described the twisting member includes the hollow spindle of a spinning-cum-twisting machine, and the device for severing the remaining component of the two-component thread in the absence of the other component, including a slit-type thread guide underlying the spindle, a deflecting wire offset from the axis of the spindle, and a bush secured to the bottom part of the spindle, for winding thereonto and breaking the component of the two-component thread that has passed through the slit-type thread guide in the absence of the other component.

In this apparatus the forced breaking of one of the components of the two-component thread is provided for by a bush of a simple design, and effected by overtensioning this component of the thread by the action of the winding unit, the breaking taking place practically at the same point where the flaw is detected, so that no defective yarn is wound into the bobbin with the final thread, and no time is wasted on its subsequent removal.

However, the winding of the component of the thread to be broken onto the bush rotating with the spindle brings about undesirable consequences. Firstly, it complicates the operation and affects the productivity, involving as it does subsesquent arresting of the spindle for cleaning the bush from the wound yarn; secondly, when the component of the thread is relatively strong, e.g., made of synthetic fiber, its tensioning aside from the axis of the spindle applies a considerable lateral load to the bearings of the spindle, thus stepping up their wear and curtailing their service life. Finally, the yarn wound onto the bush goes to waste, which increases the input of the components of the two-component thread and reduces the yield of the final thread.

SUMMARY OF THE INVENTION

It is an object of the present invention to create an apparatus for producing two-component thread, which should provide for reducing the wear of the bearings of the twisting member and for bringing down the percentage of waste of the components of the thread, thus saving the initial materials.

These and other objects are attained in an apparatus for producing two-component thread, comprising a twisting member, a holder of a bobbin with a supply of one component of the two-component thread, means for feeding the other component of the two-component thread into the twisting member, a unit for widing the two-component thread, including a package holder having an axle for its rotation, and a device for severing one component of the two-component thread when the feed of the other component of the two-component thread ceases, arranged intermediate the twisting member and the winding unit and including an element adapted to engage the two-component thread, having a slit of a width that is short of the thickness of the two-component thread and greater than the thickness of one component of the two-component thread, in which apparatus, in accordance with the invention, the element having the slit includes a hollow cylinder operatively connected with a drive, the slit in this cylinder being annular, and the internal space of this cylinder accommodating at least one flat knife with a blade situated in the area adjoining the slit.

To minimize the time of transmitting a signal on disrupted integrity of the two-component thread to the means for feeding the other component thereof, so as to terminate the feed of this other component, it is expedient to provide intermediate the twisting member and the winding unit a sensor of breakage of the two-component thread, electrically connected with the means for feeding the other component of the two-component thread and operatively connected through pivoted arm means to the axle for rotation of the hollow cylinder.

To enhance the uniformity of the delivery and winding of the two-component thread, it is practical to incorporate a delivery couple arranged intermediate the twisting member and the winding unit and including a delivery shaft and the hollow cylinder adapted to engage this shaft.

To simplify the structure of the apparatus, it is expedient to have the hollow cylinder arranged in the zone of the winding of the two-component thread, forming a part of the winding unit, the axle for rotation of the hollow cylinder extending parallel with the axle for rotation of the package holder.

To speed up the operation of severing the core thread and to avoid misbalance of the hollow cylinder, it is practical to have several flat knives mounted at uniform angular spacing in the internal space of the cylinder, extending parallel with the axis of its rotation.

The herein disclosed apparatus eliminates the necessity of winding the thread onto the twisting member for breaking the former, thus eliminating the application of a lateral load to the bearings of the twisting member, which reduces the wear of these bearings and prolongs their service life, cuts the downtime required for servicing the apparatus and brings down the percentage of waste, thus saving the initial materials and stepping up the yield of the final two-component thread.

SUMMARY OF THE DRAWINGS

The present invention will be further described in connection with embodiments thereof in an apparatus for producing one of the types of two-component thread, viz. reinforced thread having for one of its components the main or core thread and for its other component separated fibers wound or twisted about this core thread, with reference being made to the accompanying drawings, wherein.

DETAILED DESCRIPTION OF THE INVENTION

Figures 1, 2, 3:
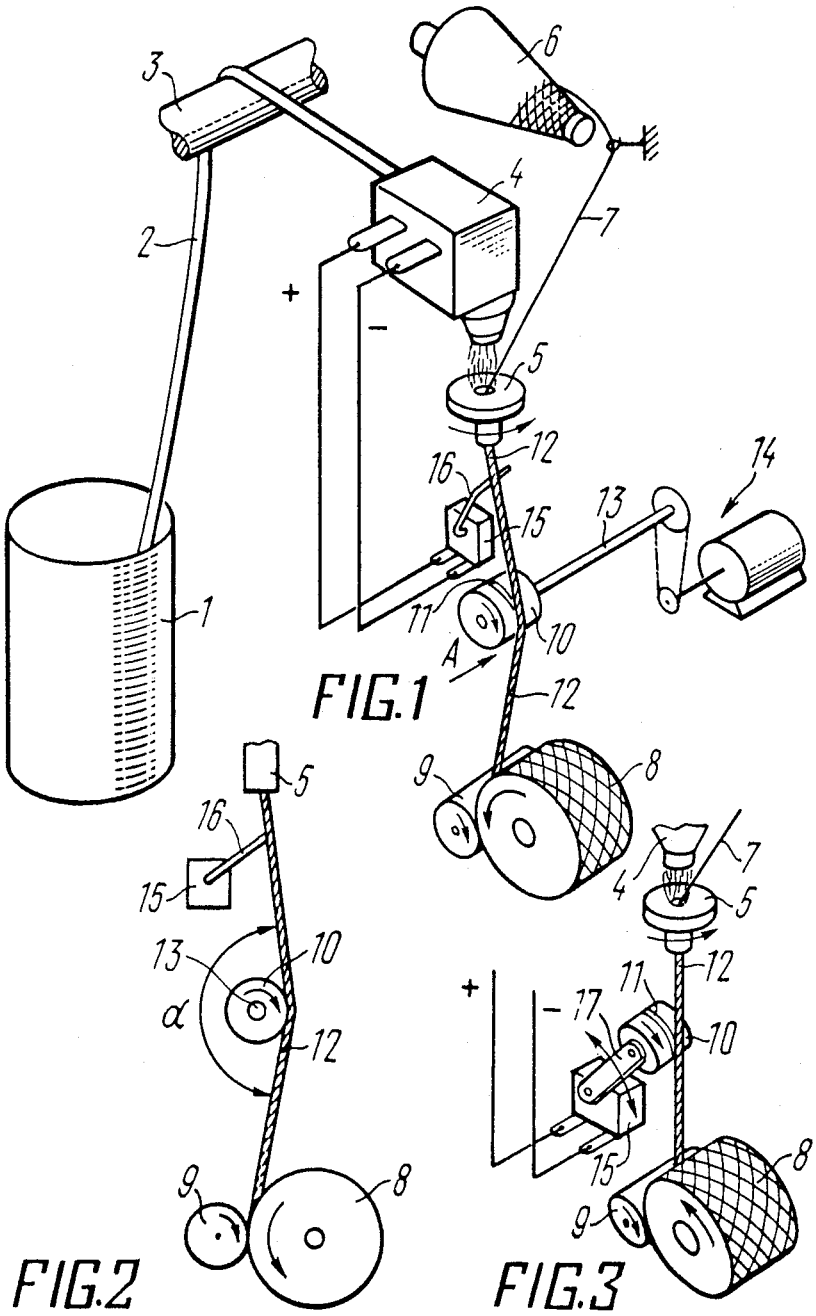
FIG. 1 is a schematic general view of the apparatus for producing reinforced thread, embodying the invention.
FIG. 2 is a view taken along arrow line A in FIG. 1, in accordance with the invention.
FIG. 3 shows a modified part of the general design of FIG. 1, with the hollow cylinder being operatively connected with the sensor through pivoted arm means, according to an embodiment of the invention.

The apparatus for producing two-component thread, e.g. reinforced thread, comprises a feed can 1 (FIG. 1) with a supply of fibrous sliver 2, a roller 3 for feeding the sliver 2 and means for feeding separated fibers which in the presently described embodiment includes a device 4 for breaking down the sliver 2 into separated fibers and feeding these fibers into a twisting member 5.

The apparatus further comprises a bobbin holder 6 with a supply of the core thread or yarn 7, and a unit for winding the reinforced thread, including a holder of a package 8 and a driven friction roller 9 urged into engagement with the package 8. Arranged intermediate the twisting member 5 and the winding unit with the package 8 is a hollow cylinder 10 with an annular slit 11 whose width is short of the thickness of the reinforced thread 12 and greater than the thickness of the core thread 7, adapted to engage the reinforced thread 12 and mounted on an axle 13 for its rotation, operatively connected with a drive 13.

To terminate selectively the feed of separated fibers from the device 4 into the twisting member 5, a sensor 15 with a feeler 16 adapted to engage the thread 12 is arranged intermediate the twisting member 15 and the hollow cylinder 10 and is electrically connected with the device 4.

To ensure the action (of severing the thread 12) of the hollow cylinder 10 (FIG. 2), the thread 12 should be bent about the cylinder 10, defining in engagement therewith an arc or angle $\alpha$ short of 180°. This bending is provided for by the appropriate positioning of the hollow cylinder 10, as shown in the drawing.

According to one embodiment of the present invention, to minimize the time of transmission of a signal by the sensor 15 to the device 4 in response to disruption of the integrity of the reinforced thread, the axle 13 for rotation of the hollow cylinder is mounted on arms 17 (FIG. 3) which are pivoted on the sensor 15. In this embodiment the hollow cylinder 10 engaged by the reinforced thread 12 acts as the feeler 16 of the sensor 15 of FIG. 1. In this embodiment the rotation of the hollow cylinder 10 is effected through a flexible friction transmission including pulleys 18 (FIG. 4) and an endless flexible member 19, the axis of rotation of one pulley 18 being aligned with the pivot axis of the arms 17, and that of the other pulley 18 being aligned with the axle 13 for rotation of the hollow cylinder 10.

Figure 5:
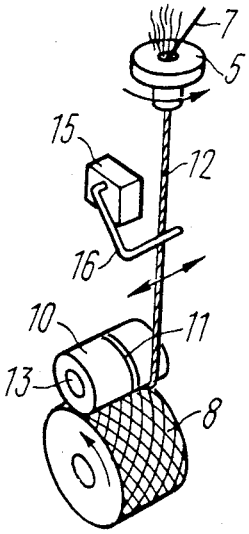
FIG. 5 shows a modified part of the general design of FIG. 1, with the hollow cylinder being arranged in the zone of the winding of the reinforced thread, forming a part of the winding unit, according to yet another embodiment of the invention.

According to another embodiment, the hollow cylinder 10 (FIG. 5) is arranged in the zone of the winding of the reinforced thread 12 in engagement with the package 8 and forms a part of the winding unit, performing the function of the driven friction roller 9 of FIG. 1.

Figure 6:
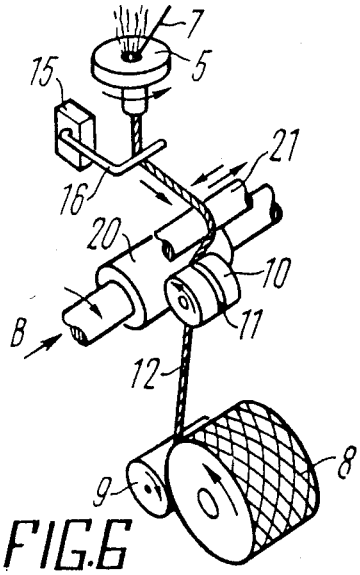
FIG. 6 shows a modified part of the general design of FIG. 1, with the hollow cylinder engaging a delivery shaft and forming a part of a delivery couple, according to a further embodiment of the invention.

According to yet another embodiment of the invention, to enhance the uniformity of delivering and winding of the reinforced thread, a delivery couple is arranged intermediate the twisting member 5 (FIG. 6) and the winding unit, including a delivery shaft 20 associated with a drive (not shown) for its positive rotation, and the hollow cylinder 10. In this embodiment the hollow cylinder 10 is mounted for free rotation on its axle 13, to be revolved in operation by its engagement with the delivery shaft 20. A reciprocal traversing guide 21 is preferably incorporated in this embodiment, to avoid excessive local wear of the surface of the delivery shaft 20.

Figure 7:
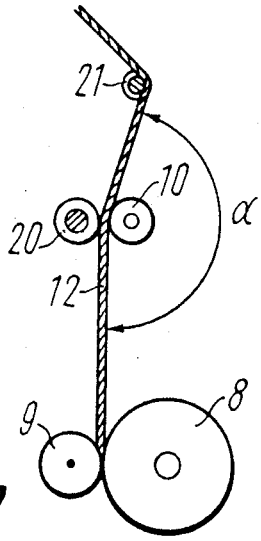
FIG. 7 is a view taken along arrow line B in FIG. 6, in accordance with the invention.

To ensure the action (of severing the thread 12) of the hollow cylinder 10 of this embodiment, the thread 12 (FIG. 7) should be bent about the hollow cylinder 10 at the point of the nip of the delivery couple, defining an engagement angle or arc $\alpha < 180°$, which is provided for by appropriate positioning of the traversing guide 21 engaged by the running thread 12.

Figure 8:
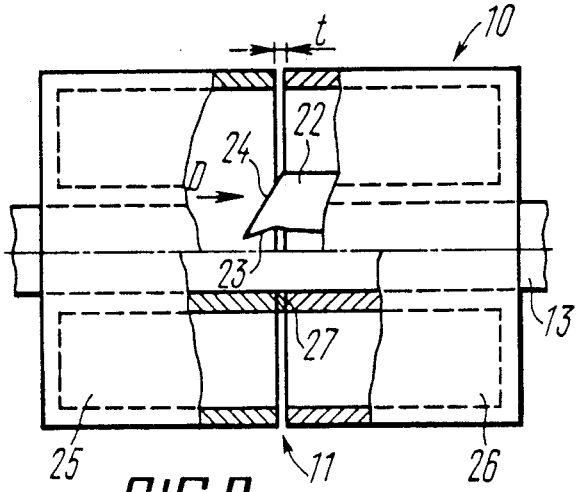
FIG. 8 shows on a larger scale a partly longitudinally sectional view of the hollow cylinder in accordance with the invention.

The internal space of the cylinder 10 (FIG. 8) accommodates at least one flat knife 22 with a blade 23 situated in the zone adjoining the slit 11. To facilitate the slipping of the thread 12 into the slit 11 to underlie the blade 23 of the knife 22, the end face 24 of the knife 22 is chamfered.

The hollow cylinder 10 is preferably made up of two closed-end sleeves 25 and 26 mounted on the axle 13 and separated by a gasket 27 acting as a spacer for adjusting the width of the slit 11.

Figure 9:
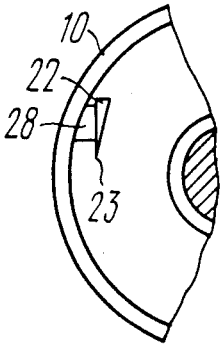
FIG. 9 is a view taken along arrow line D in FIG. 8, in accordance with the invention.

A bracket 28 (FIG. 9) is provided for mounting the knife 22 in the internal space of the cylinder 10.

Figure 10:
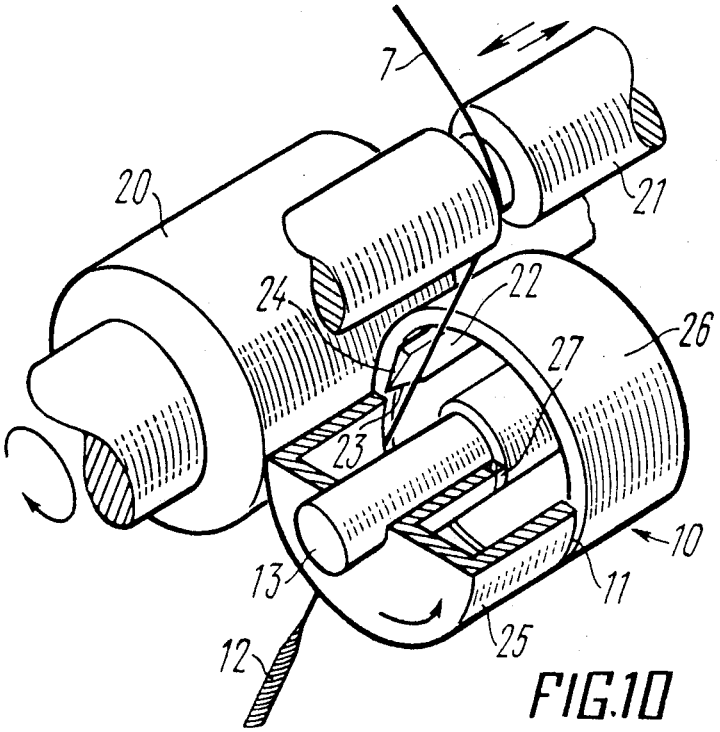
FIG. 10 illustrates in more detail in a perspective partly cutaway view the delivery couple, with the core thread passing through the slit of the hollow cylinder to underlie the blade of the knife, according to the invention.

FIG. 10 of the appended drawings illustrates in greater detail the delivery couple as the core thread 7 passes into the slit 11 of the hollow cylinder 10 to underlie the blade 23 of the knife 22.

Figure 11:
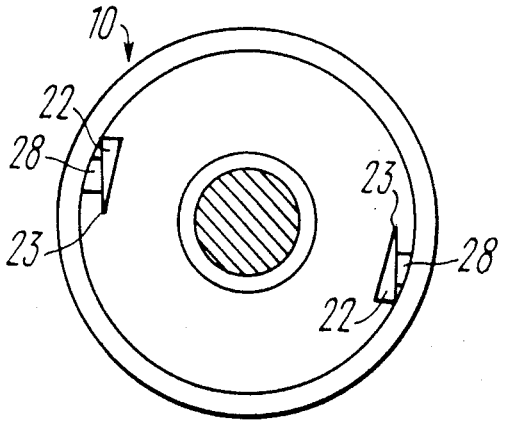
FIG. 11 illustrates in more detail in a cross-sectional view the structure of the hollow cylinder with two flat knives, according to an embodiment of the invention.
Figure 12:
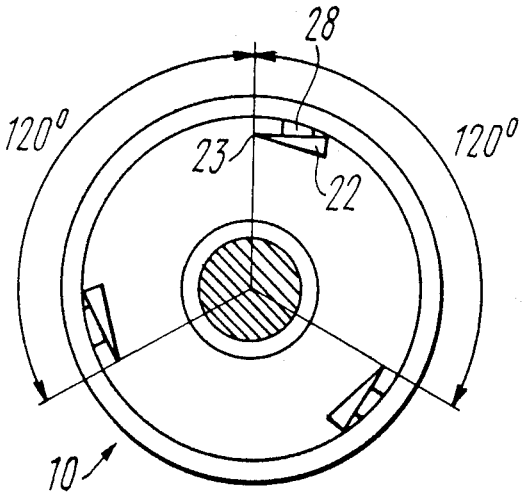
FIG. 12 illustrates in more detail in a cross-sectional view the structure of the hollow cylinder with three flat knives, according to an embodiment of the invention.

The internal space of the hollow cyliner 10 may have radially arranged therein in a plane perpendicular to the axle 13 of the cylinder 10 several knives 22 (FIGS. 11 and 12) uniformly angularly spaced in this plane. The actual number of the knives 22 is selected to correspond to the angular speed of the hollow cylinder 10, and to the time required for severing the core thread 7.

The herein disclosed apparatus, although described in connection with its embodiments for producing reinforced thread, may be successfully employed for production of other kinds of two-component thread, e.g., twisted thread.

The apparatus embodying the present invention operates as follows. From the feed can 1 (FIG. 1) the fibrous sliver 2 runs about the feed roller 3 into the device 4 where it is separated into individual fibers. The stream of separated fibers is fed into the twisting member 5. Simultaneously, the core thread 7 is fed from the supply bobbin 6 into the revolving twisting member 5, to have the separated fibers wound about it and to emerge from the twisting member 5 as the final reinforced thread 12 guided toward the winding unit which winds it into a package 8 by the operation of the driven friction roller 9 and an appropriate traverser (not shown). While running from the twisting member 5 toward the winding unit, the reinforced thread 12 is engaged at appropriate tension by the hollow cylinder 10 rotating on its axle 13 under the action of the drive 14, with the thread 12 defining with the cylinder 10 the engagement angle $\alpha < 180°$ (FIG. 2).

Should the feed of separated fibers into the twisting member 5 accidentally cease (e.g., on account of the exhaustion of the supply of the feed sliver 2 or its breakage), the remaining thinner core thread 7 continues its running and, while engaging the periphery of the hollow cylinder 10, slips into its slit 11, slides down the chamfered end face 24 (FIG. 8) of the knife 22 into the internal space of the cylinder 10 and is severed by the blade 23 of the knife 22 in the course of the successive revolution of the hollow cylinder 10 (FIG. 10).

This prevents the winding of the bare core thread 7 into the package 8, thus saving the waste of the core thread 7 and resulting in saving of the initial materials and in an increased yield of the final reinforced thread, while curtailing the downtime of the apparatus required for its servicing.

As the bare core thread 7 is thus severed inside the hollow cylinder 10, the tension of the thread 12 drops and the feeler 16 (FIG. 1) of the sensor 15 is no longer supported by the running thread 12 and falls, causing the closing of contacts (not shown) in the sensor 15, whereby the latter sends a signal via the electric circuit to terminate the operation of the fiber-separating device 4. Preferably, the twisting member 5 and the winding unit are also disengaged.

Figure 4:
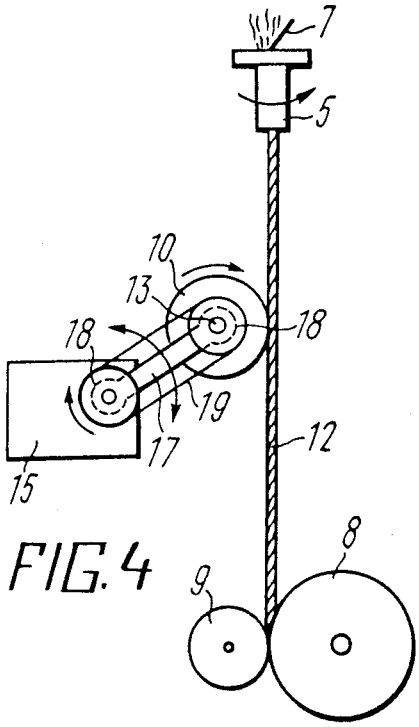
FIG. 4 shows a modified part of the general design of FIG. 1, with the hollow cylinder being operatively connected with the sensor through pivoted arm means and with a drive according to another embodiment of the invention.

The sensor 15 (FIGS. 3 and 4) of the embodiment illustrated in FIGS. 3 and 4 responds by sending a signal to the device 4 the moment the bare core thread 7 slips into the slit 11 and the hollow cylinder 10 descends under its own weight, because in this embodiment the sending of the signal by the sensor 15 is actually triggered not by the dropping tension of the thread 12 as the bare core thread 7 is severed, but by the arms 17 pivoting down with the hollow cylinder 10, which may take place even before the bare core thread is actually severed, and this in certain emergency cases, e.g., of fibers clogging the separating mechanism in the device 4, could be of essential importance, as the friction of compacted fibers against internal stationary parts of the device 4 might cause inflammation of the fibers. With the hollow cylinder of this embodiment being rotated through the flexible endless member 19 running about the pulleys 18 whose axes are aligned, respectively, with the pivot axis of the arms 17 and with the axle of rotation of the hollow cylinder 10, unobstructed pivoting of the arms 17 caused by the hollow cylinder 10 descending as the bare core thread 7 slips into its slit 11 is provided for.

The hollow cylinder 10 (FIG. 5) replaces the driven friction roller 9 (FIG. 1) in the winding unit for rotating the package 8 and the structure of the apparatus is simplified, as the apparatus no longer needs the friction roller 9 with various components (not shown in the drawing) required for its positive rotation.

The delivery couple arranged intermediate the twisting member (FIG. 6) and the winding unit, having its nip formed by the positively rotated delivery shaft 20 and the hollow cylinder 10 mounted in engagement with this shaft 20 for free rotation on its axle 13, provides for enhanced uniformity of the delivery of the reinforced thread 12 by the twisting member 5, and its more uniform winding into the package 8 in the winding unit. This, in its turn, provides for more uniform winding of the fibers in the twisting member 5 about the core thread 7 and enhanced structure of the reinforced thread 12, and also for more regular arrangement of the thread 12 in the successive layers of the package 8. The traversing guide 21 overlying the delivery couple and reciprocating the reinforced thread 12 axially of the delivery shaft 20, firstly, reduces the local wear (by scoring) of the periphery of the delivery shaft 20 under the action of the running thread 12, thus resisting slackening of the nipping of the thread 12 by the delivery couple, and, secondly, provides for an engagement angle or arc $\alpha < 180°$ (FIG. 7) in the nipping of the reinforced thread 12 by the delivery couple, necessary for the slipping of the bare core thread 7 into the slit 11 of the hollow cylinder 10 to be severed therein if the reinforcement process becomes disrupted.

With several knives 22 (FIGS. 11 and 12) provided in the internal space of the hollow cylinder 10, the severing of the bare core thread 7 is speeded up, while the uniform circumferential arrangement of these knives 22 minimize misbalance of the hollow cylinder 10 as the latter is rotated.

In the herein disclosed apparatus the effort applied to the bare core thread 7 for its severing is directed axially of the thread 7, and, consequently, axially of the twisting member 5, which eliminates lateral loading of the latter's bearings and thus reduces their wear and prolongs the service life of the apparatus. The same result is obtained from the use of the knife 22 with its blade 23 simplifying the severing of the bare core thread 7 with a smaller effort required. Furthermore, the hollow cylinder 10 monitoring the integrity of the reinforced thread 12 with its practically instant severing when a flaw is detected prevents the bare core thread 7 from being wound into the package 8, so that the waste of the core thread is reduced, the input of the initial materials are saved, and the downtime required for servicing the apparatus is also reduced.

We claim:

1. An apparatus for producing two-component thread, comprising:

a twisting member;

a bobbin with a supply of one component of the two-component thread;

a holder for said bobbin;

means for feeding the other-component of said two-component thread into said twisting member;

a unit for winding said two-component thread into a package;

a holder for said package; means for rotating said holder for said package;

a device for severing one component of said two-component thread upon termination of the feed of the other component of the two-component thread, arranged intermediate said twisting member and said winding unit;

said device for severing said one component of said two-component thread including an element adapted to engage said two-component thread and having a slit of a width which is less than the thickness of said two-component thread and greater than the thickness of said one component of said two-component thread;

said element having said slit including a hollow cylinder wherein said slit is annular, said hollow cylinder having an internal space; drive means associated with said hollow cylinder; means for rotating said hollow cylinder;

at least one flat knife, said knife having a blade;

said at least one knife being accommodated in said internal space of said hollow cylinder;

said blade of said flat knife being situated in the zone adjoining said slit.

2. An apparatus as set forth in claim 1, comprising a sensor for determining breakage of said two-component thread arranged intermediate said twisting member and said winding unit, and being electrically connected with said means for feeding said other component of said two-component thread;

pivoted arm means;

said sensor for determining breakage of said two-component thread being connected through said pivoted arm means with said means for rotating said hollow cylinder.

3. An apparatus as set forth in claim 1, comprising a delivery couple arranged intermediate said twisting member and said winding unit, the delivery shaft of said delivery couple being adapted to engage said hollow cylinder.

4. An apparatus as set forth in claim 1, wherein said hollow cylinder is arranged in the zone of winding of said two-component thread, forming a part of said winding unit.

5. An apparatus as set forth in claim 1, wherein said internal space of said hollow cylinder accommodates therein a plurality of flat knives arranged radially at uniform spacing in a plane perpendicualr to the axis of rotation of said hollow cylinder.

* * * * *